US006418761B1

(12) United States Patent
Wytcherley et al.

(10) Patent No.: US 6,418,761 B1
(45) Date of Patent: Jul. 16, 2002

(54) LATCH

(75) Inventors: Roger Wytcherley, Suckley; David Sorin, Tewksbury; David Storer, Bradway, all of (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/596,164

(22) Filed: Jun. 16, 2000

Related U.S. Application Data

(60) Provisional application No. 60/139,389, filed on Jun. 16, 1999.

(51) Int. Cl.[7] ..... E05B 13/00

(52) U.S. Cl. ..... 70/208; 70/210; 292/210

(58) Field of Search ..... 70/208, 210, 125, 70/127, 128, 475, 478, 484, 485, DIG. 31; 292/210, 108, DIG. 31

(56) References Cited

U.S. PATENT DOCUMENTS 4,370,874 A * 2/1983 Munn ..... 292/210 X
4,556,244 A * 12/1985 Bisbing ..... 292/336.3 X
4,583,775 A * 4/1986 Bisbing ..... 292/64
4,706,478 A * 11/1987 Swan et al. ..... 70/208
4,838,054 A 6/1989 Weinerman et al. ..... 70/208
4,898,408 A * 2/1990 Hauber ..... 70/208 X
5,015,019 A * 5/1991 Razdolsky ..... 292/210 X
5,184,853 A * 2/1993 Whatley ..... 292/205
5,913,908 A * 6/1999 Czipri ..... 70/208
5,987,942 A * 11/1999 Ichinose ..... 70/208

FOREIGN PATENT DOCUMENTS

DE 834816 * 7/1949 ..... 70/208

OTHER PUBLICATIONS

"Southco Handbook 2000," by Southco Inc., 1996, pp 26–37.

"Southco Handbook 2000," by Southco Inc., 1999 pp. 144–146.

* cited by examiner

*Primary Examiner*—Lloyd A. Gall
(74) *Attorney, Agent, or Firm*—Paul & Paul

(57) ABSTRACT

A latch includes a cup, a latch assembly mounted in the cup and having a pivotal handle and a lock having a lock pawl selectively rotatable to a locked position to prevent operation of the latch assembly.

15 Claims, 7 Drawing Sheets

LATCH

CROSS-REFERENCE TO RELATED APPLICATIONS

This application claims the benefit of the priority of U.S. Provisional Patent Application No. 60/139,389, filed on Jun. 16, 1999.

BACKGROUND OF THE INVENTION

1. Field of the Invention

The present invention relates generally to latching devices and more particularly to latching devices for securing a first member such as a door, panel or the like in a closed position relative to a second member such as a corresponding door, panel or frame.

2. Brief Description of the Prior Art

Various types of latching devices for use in securing a first member such as a door, panel or the like in a closed position relative to a corresponding second member such as a door, panel or frame are known.

Some types are termed "compression latches" in that a pawl or similar member is moved in order to compress first and second members together in a latched position. Examples of compression latches are disclosed in U.S. Pat. Nos. 4,583,775 and 4,556,244, each to Robert H. Bisbing and assigned to Southco, Inc, the assignee of the present application.

The present invention discloses a modified latch for securing first and second members.

SUMMARY OF THE INVENTION

An object of the present invention is to provide a compression latch sufficiently robust in design for a variety of applications.

Another object of the present invention is to provide a latch having a low profile so as to not extend out from the surface of the member in which the latch is mounted.

Still another object of the present invention is to provide a latch having a lock to prevent unwanted operation.

In accordance with the objects set forth above, the present invention discloses an embodiment comprising a latch of the compression type and with the latch being housed within a flush mounted cup and including a foldable handle and integral lock.

These and other objects of the present invention will become more readily apparent from a review of the following description and attached drawings.

DETAILED DESCRIPTION OF THE PREFERRED EMBODIMENTS

Illustrated in the figures is an embodiment of a latch in accordance with the present invention. As will be described in more detail herein, the latch 10 illustrated in the present embodiment incorporates the aspects that the latch is of the compression type, includes means for locking as well as includes means for low profile mounting and operation. As should be understood, however, a latch in accordance with the present invention can be provided in other configurations as well, for example, having fewer than all of the aspects noted above or having the same or similar aspects but in different combinations. Notwithstanding, there are certain unique benefits and advantages in the configuration of the latch 10 in the illustrated embodiment, which will be described in detail in the following paragraphs. In accordance with the present embodiment, the latch 10, includes as portions thereof, a housing 12, a latch assembly 14 and a lock 16.

Figure 5:
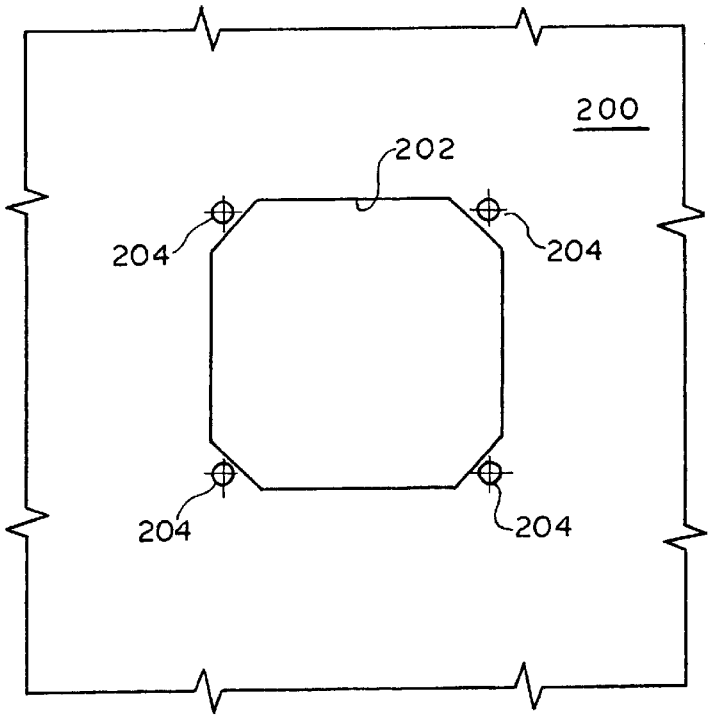
FIG. 5 is a top plan view of a panel prepared for mounting of the latch of FIG. 1.
Figure 6:
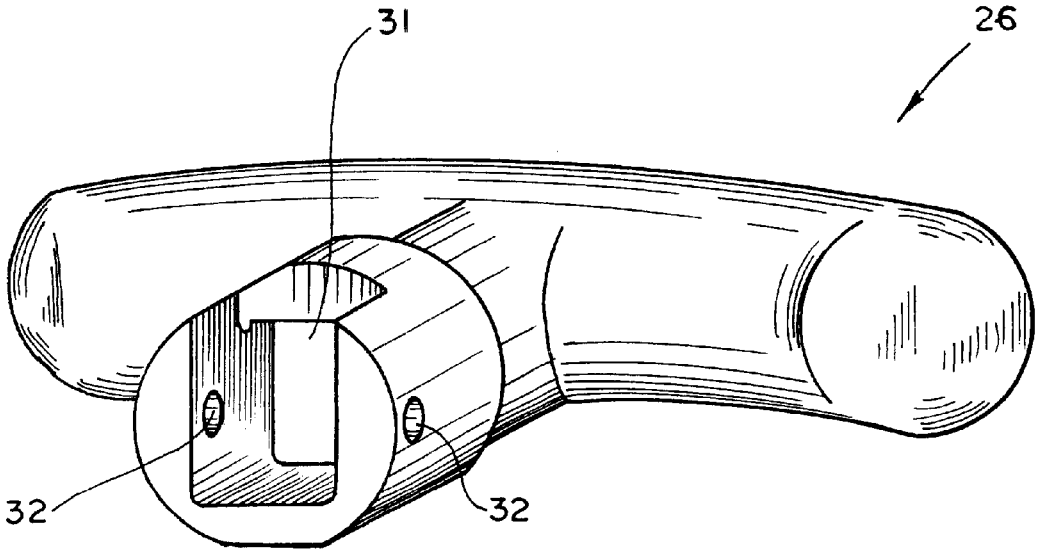
FIG. 6 is an isolated perspective view, slightly enlarged, of the handle of FIG. 1.
Figure 7:
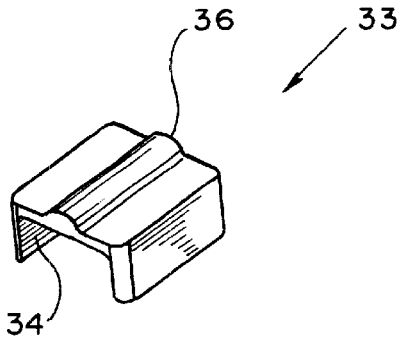
FIG. 7 is an isolated perspective view, slightly enlarged, of an insert of the latch assembly of FIG. 1.
Figure 9:
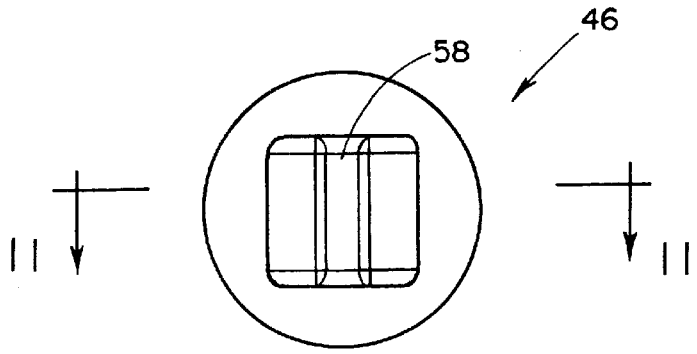
FIG. 9 is an isolated top plan view, slightly enlarged, of a driver of the latch assembly of FIG. 1.
Figure 10:
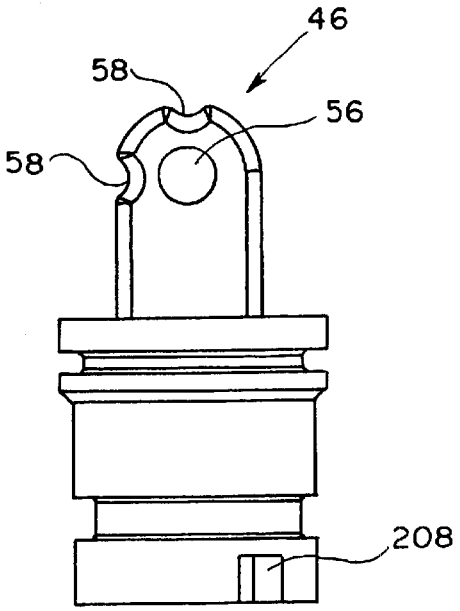
FIG. 10 is a front elevational view of the driver of FIG. 9.
Figure 11:
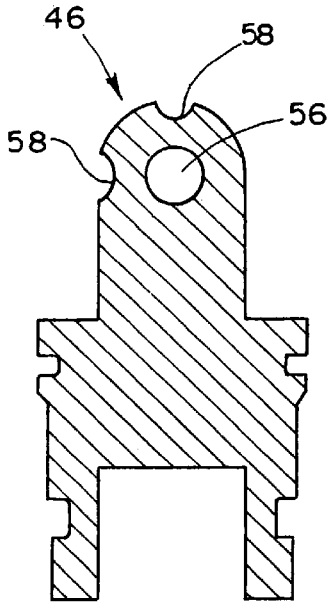
FIG. 11 is a sectional front elevational view of the driver of FIG. 9 taken along the line 11—11 of FIG. 9.
Figure 8:
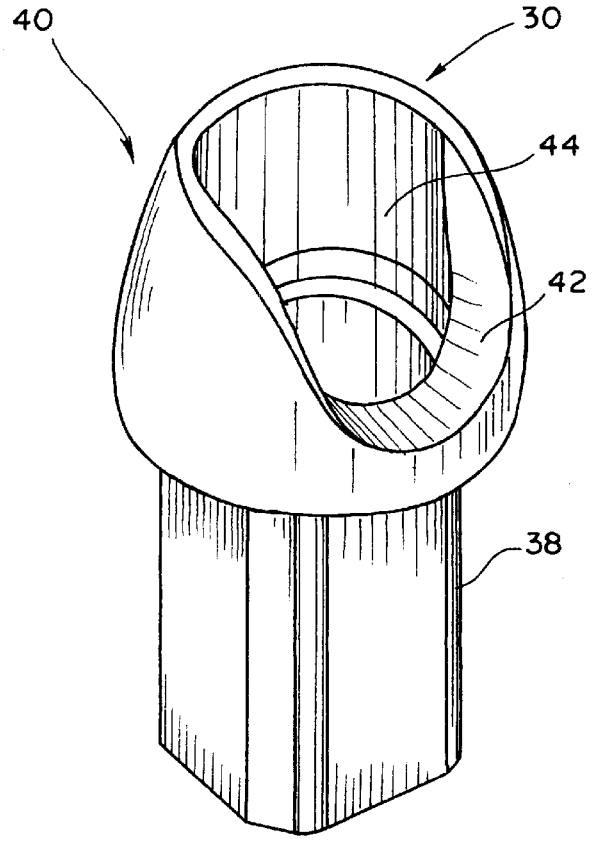
FIG. 8 is an isolated perspective view, slightly enlarged, of a housing of the latch assembly of FIG. 1.
Figure 12:
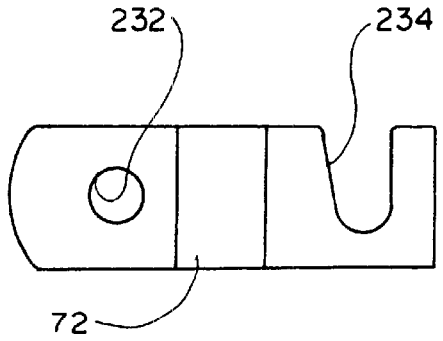
FIG. 12 is an isolated top plan view, slightly enlarged of a lock pawl of the lock of FIG. 1.

The housing 12 in this embodiment comprises a cup receptacle preferably of pressed steel manufacture and having means for mounting the cup 12 to a closure member, such as a door, lid, panel, drawer, etc. The cup 12 is normally mounted in an aperture or cavity provided in the closure member. The cup 12 also includes means for mounting the latch assembly 14 and means for mounting the lock 16, which allow the latch assembly 14 and the lock 16 to be mounted to the cup 12. The means for mounting the cup 12 to a closure member in the present embodiment comprises at least one and preferably four mounting studs 18 secured to a rear wall of the cup 12, such as by welding. In the illustrated example the mounting studs 18 are in the form of cylindrical projections having threaded holes or bores for the engagement of well-known threaded fasteners used to secure the cup 12 to the closure member. As an alternative, the mounting studs may be externally threaded and be engaged by nuts on the backside of the closure member to secure the cup 12 to the closure member. More preferably, the hole pitch of the studs 18 are symmetrical, which allows the mounting of the latch 10 in the vertical and horizontal positions. In the illustrated example, the outside of the cup 12 is of a stylized, curved design which follows the shape of the concave inner surface of the cup 12. Referring to FIG. 5, a closure panel 200 prepared to receive the cup 12 can be seen. The closure panel 200 is prepared by having an aperture 202, sized to receive the cup 12, formed therein. The aperture 202 has flat sides for ease of manufacture. Four small holes 204 are provided about the aperture 202. The holes 204 register with the mounting studs 18 and allow fasteners to engage the mounting studs 18 for the purpose of securing the cup 12 to the closure member 200. The means for mounting the latch assembly 14 comprises an aperture 20 preferably corresponding in configuration to the outer boundary of a cross-section of the housing of the latch assembly 14. In the illustrated example, the aperture 20 generally has four flat sides joined by four arcuate sides, each arcuate side extending between a pair of flat sides. Similarly, the means for mounting lock 16 comprises an aperture 22 configured so as to receive lock 16. The aperture 22 is substantially circular with opposing square notches in the present embodiment.

Latch assembly 14 of the present embodiment is preferably of the type known as a compression latch. An example of a compression latch suitable for use as part of the present invention is described and claimed in U.S. Pat. No. 4,583,775 ('775 Patent) referenced above and entitled "Latch Assembly Having Pull-Up Action", which is incorporated by reference herein. For the sake of brevity, the portions of latch assembly 14 corresponding to that set forth in the '775 patent will not be described in detail herein, and instead, the description will focus on the specific differences. The latch assembly 14 similar to the latch of the '775 Patent comprises a housing 30, a shaft 50 and latching means such as a latching pawl 70 mounted on the shaft 50.

The latching pawl 70 is movable rotationally by shaft 50 and is also moveable by shaft 50 axially in the longitudinal direction of the shaft. To latch a closure member to a frame member, such as a door frame, the latching pawl 70 is first rotated to a position such that it is in line with the frame member. The latching pawl 70 and the shaft 50 are then moved longitudinally as a unit in order to bring the latching pawl 70 into engagement with the edge of the frame member. The shaft 50 is moved rotationally and also longitudinally by means of a rotatable actuator. In the present embodiment, the rotatable actuator comprises a handle 26, which is described in detail below. References to longitudinal movement and axial movement are used interchangeably herein and refer to the translational movement of the latching pawl, or the translational movement of the shaft to which the latching pawl is attached, in a direction parallel to or coincident with the longitudinal axis of the shaft to which the latching pawl is attached. References to rotational movement or motion as used herein refer to the rotational movement of the latching pawl, or the rotational movement of the shaft to which the latching pawl is attached, with the axis of rotation being coincident with the longitudinal axis of the shaft to which the latching pawl is attached.

Figure 1:
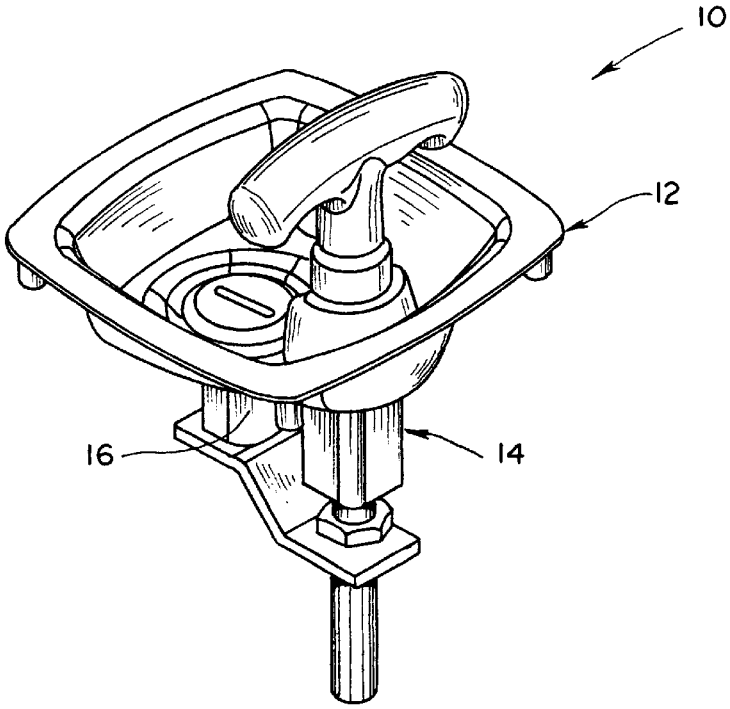
FIG. 1 is a perspective view of a latch in accordance with an embodiment of the present invention and illustrating a handle of a latch assembly in an open position and a lock in a locked position.
Figure 2:
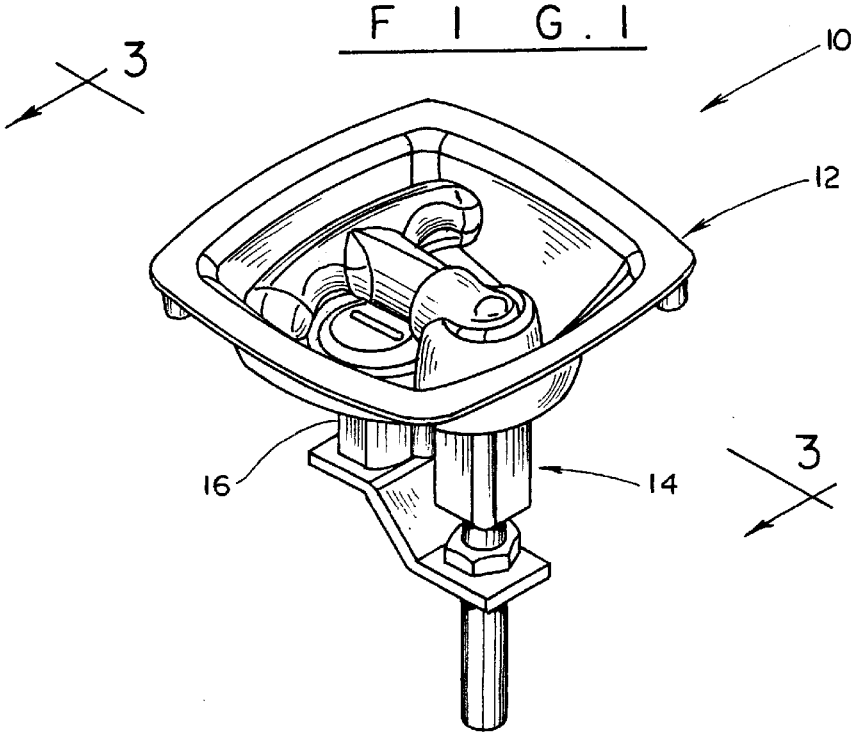
FIG. 2 is a perspective view of the latch of FIG. 1 and illustrating the handle in a closed position.
Figure 13:
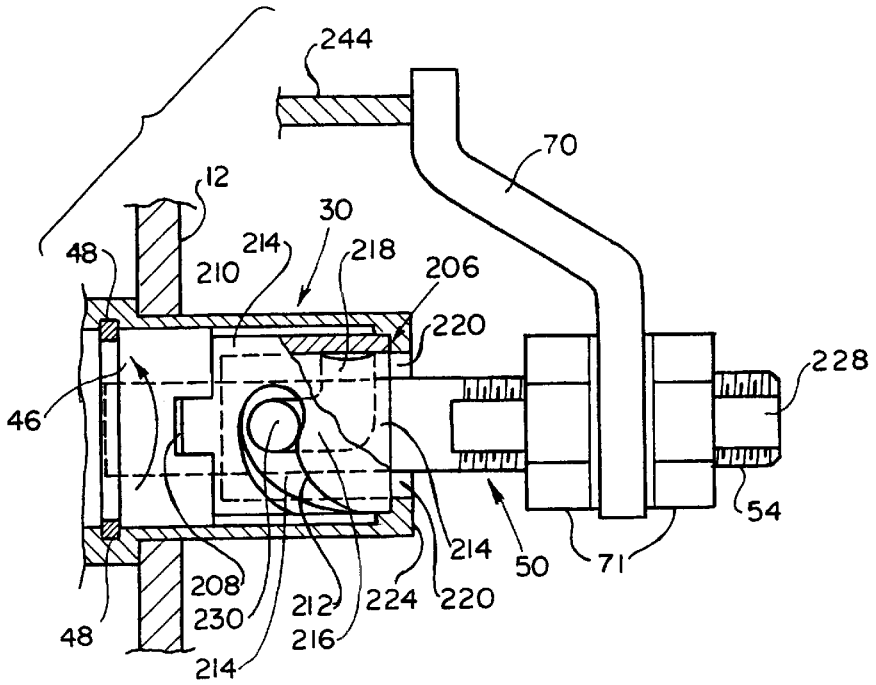
FIG. 13 is a view of an example of a compression latch mechanism usable with the present invention, shown in the fully latched position, and with the housing broken away to show internal details.
Figure 3:
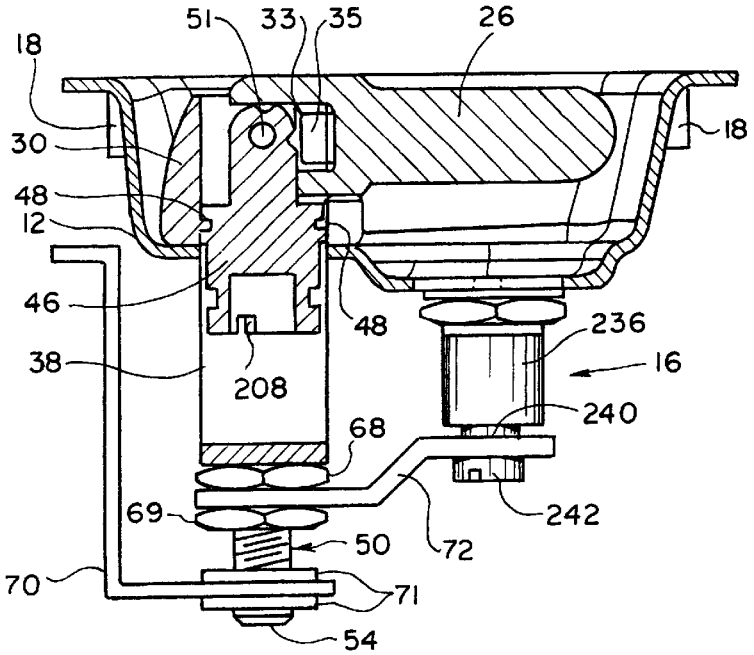
FIG. 3 is a sectional right side elevational view of the latch of FIG. 2, slightly enlarged, and taken along line 3—3 of FIG. 2.
Figure 4:
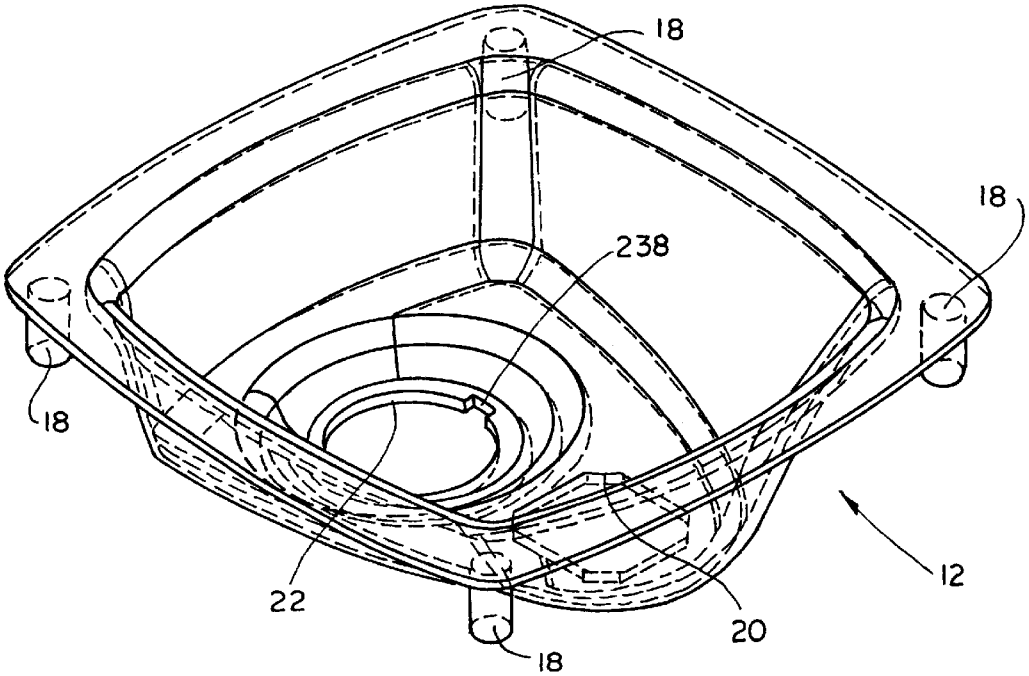
FIG. 4 is a slightly enlarged isolated perspective view of a cup of the latch of FIG. 1.
Figure 14:
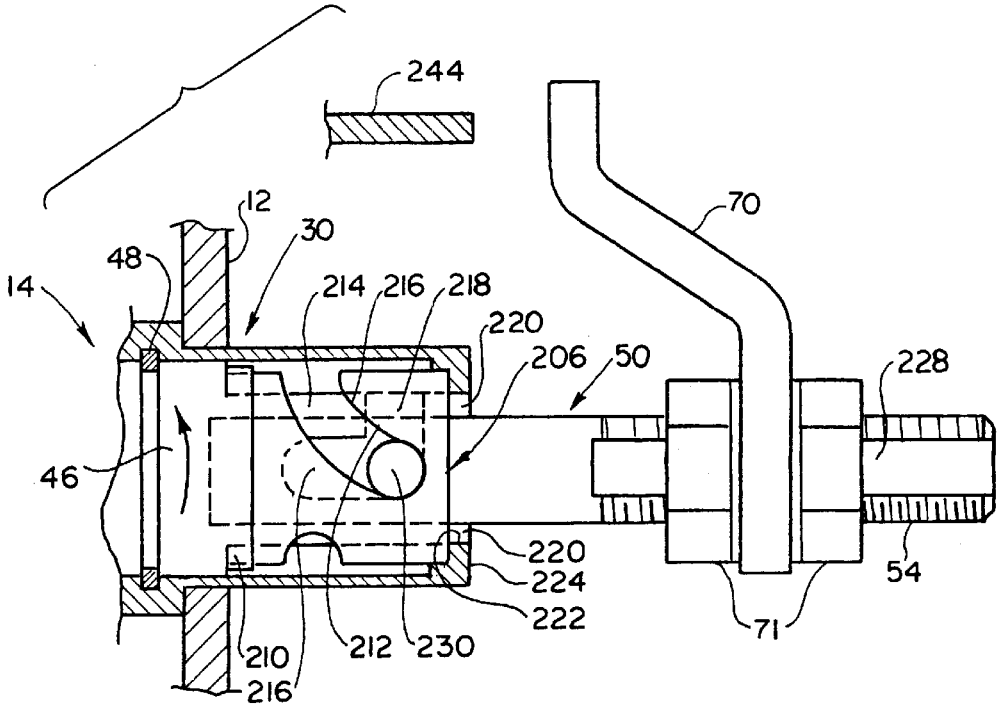
FIG. 14 is a view of an example of a compression latch mechanism usable with the present invention, shown with its shaft fully extended, and with the housing broken away to show internal details.
Figure 15:
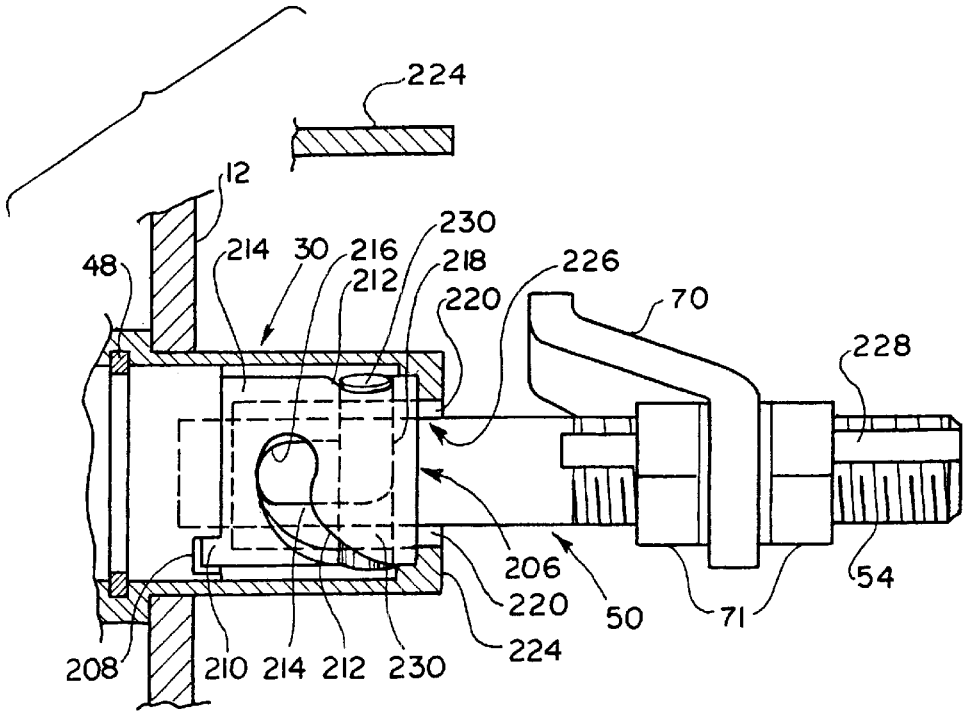
FIG. 15 is a view of an example of a compression latch mechanism usable with the present invention, shown in the unlatched position, and with the housing broken away to show internal details.

The handle 26 in this embodiment is pivotally connected to the latch assembly 14 and preferably includes detent means to retain the handle 26 in defined positions through its range of pivotal motion. In the illustrated embodiment, the handle 26 is a T-handle and includes a rectangular cavity 31 in its terminating end which is distal from the grasping portion of the T-handle 26. Opposing mounting holes 32 are provided on either side of the cavity 31 and extend through the walls of the cavity 31. The mounting holes 32 are in alignment with one another. An insert 33 preferably of resilient plastic is mounted in the rectangular cavity 31 of handle 26. The insert 33 is in the form of a hollow rectangular parallelepiped that is open on at least one side, preferably open on three sides for added flexibility, so as to form a rectangular cavity 34. A elongated rib 36 projects from the side of the insert 33 opposite the cavity 34. In this embodiment, biasing means preferably comprising an elastomer slug 35 is positioned within the rectangular cavity 34 of insert 33. The handle 26 is then pivotally connected to the cap or driver 46 of the latch assembly 14. The latch assembly 14 includes a cap or driver 46 which is rotatably supported by the central bore of the housing 30 such that at least a portion of the driver 46 lies within the bore of the housing 30. Housing 30 is generally mushroom-shaped in this embodiment comprising an elongate body 38 having an outer surface preferably corresponding in shape to aperture 20 in cup 12 and a head 40 having a cavity 42 in its side wall 44. Driver 46 in the present embodiment is preferably prevented from movement in the axial direction of shaft 50, such as by a retaining ring 48 received within grooves located in registered positions in driver 46 and housing 30. The end of the driver 46 distal from the head 40, is connected with a sleeve-like cam 206 in the manner shown in FIGS. 13–15. A pair of notches 208 formed in the driver 46 receive ears 210 projecting axially outward from the end of the sleeve-like cam 206 closest to the driver 46. The driver 46 has at its outward end a mounting hole 56 and at least one, and in this embodiment, two depressions 58, and with each depression 58 being generally radiused and at spaced separation, which is at approximately 90 degree separation in the present embodiment. The handle 26 is then pivotally coupled with the driver 46 by a conventional pivot pin 51 extending through the opposing mounting holes 32 of handle 26 and mounting hole 56 of driver 46. Thus, when handle 26 is in an extended position and is rotated, the sleeve-like cam 206 is also rotated.

As set forth in the '775 Patent, the sleeve-like cam 206 within housing 30 is provided with at least one and, in the present embodiment, a pair of cam slots 212 spaced 180° apart circumferencially. Each of the slots runs in a direction which has both circumferencial and axial components. Further, preferably positioned coaxially between shaft 50 and the sleeve-like cam is a fixed motion-control sleeve 214 having a pair of axial slots 216 and a pair of lateral or circumferencial slots 218. In the present embodiment, one slot of each pair is spaced 180° from the other. The end of each axial slot 216, which is farthest from the head 40, connects with one end of a respective one of the circumferencial slots 218 to form an L-shaped motion-control slot. The motion-control sleeve 214 is prevented from moving rotationally relative to housing 30, such as by a pair of ears 220 projecting from the end of the motion control-sleeve 214 farthest from the head 40, which are received in a pair of slots 222 in the second end 224 of the housing 30. The pair of L-shaped slots in the motion-control sleeve 214 function to permit rotational motion and axial motion of the shaft 50 in sequence.

As best illustrated in the figures, shaft 50 is an elongated shaft and projects out from the opening 226 through the second end 224 of the housing 30. The shaft 50 lies at least in part within the bore of the housing 30 and is supported such that the center axis of the shaft coincides with the center axis of the motion-control sleeve 214 and the sleeve-like cam 206. Alternatively, the sleeve-like cam 206 may be positioned intermediate the shaft 50 and the motion-control sleeve 214 without affecting the function of the latch assembly 14.

A portion of shaft 50 is threaded adjacent the end 54 of the shaft 50 which is located outside the housing 30. The threaded portion of shaft 50 has a pair of flats 228 provided on either side thereof. The threaded portion of the shaft 50 passes through a hole at one end of the pawl 70. The pawl 70 is prevented from axial movement relative to the shaft 50 by a pair of nuts 71 which are engaged to the threaded portion of the shaft 50. The nuts 71 allow the position of the pawl 70 along the shaft 50 to be axially adjustable. The nuts 71 may be tightened to grip the pawl 70 between the nuts 71 with sufficient frictional force such that the shaft 50 and the pawl 70 move as a unit. More preferably, the hole through the pawl 70 has flat sides which match the flats 228 of the threaded portion of the shaft 50 such that greater torque can be applied to the pawl 70 without any relative rotational motion between the pawl 70 and the shaft 50. Retaining means comprising spaced apart nuts 68 and 69 are also included in this embodiment. Preferably, the nuts 68 and 69 are of the type that is self-locking. The nuts 68 and 69 are secured on shaft 50 in spaced-apart relationship to one another. The nuts 68 and 69 interact with lock 16 in operation, as will be described below. Further, mounted on the shaft 50 is a cross-pin 230, which projects laterally in both directions from the shaft 50 and functions as both a cam follower and as a motion-control pin.

The end of shaft 50 closest to the driver 46, can further be provided with a center bore in which a coil compression spring is placed. In one embodiment, an end of the compression spring can bear against the driver 46. In this manner, the compression spring operates to bias shaft 50 toward projecting outward from the second end 224 of the housing 30. This biasing force maintains the ends of the cross pin 230 in close contact with the sides of the cam slots farther from the driver 46. The biasing spring is desirable but not essential since even without the spring, the ends of the cross pin 230 would follow the cam slots. The cross pin 230 controls whether, in response to rotation of the driver 46, the shaft 50 and pawl 70 will move only axially or only rotationally. This is determined by whether the opposite ends of the cross pin are within the axial motion-control slots 216 or in the lateral motion-control slots 218.

The lock 16 in this embodiment is a conventional cylinder lock having a key-operated lock plug or lock cylinder supported in a cylinder lock housing. The cylinder lock housing 236 is externally threaded and is mounted in the aperture 22 in cup 12. The cylinder lock housing 236 has external projections which fit into slots 238 of the aperture 22 and prevent relative rotation between the lock housing 236 and the cup 12. Lock 16 further comprises means for engaging the latch assembly 14 comprising a lock pawl 72. In this embodiment, the lock pawl 72 is generally elongated and has a mounting hole 232 at one end and a U-shaped opening 234 proximate its opposite end. The lock pawl 72 is attached to the lock plug of the lock 16 such that the lock pawl 72 and the lock plug of the lock 16 rotate as a unit. The lock pawl 72 is fixed to the lock plug of the lock 16 using its mounting hole 232 and an appropriate fastener. As an example, a screw may be passed through the mounting hole and engaged to a threaded hole provided in fixed relationship to the lock plug of the lock 16. Tightening the screw would frictionally hold the lock pawl 72 in place such that the lock pawl rotates with the lock plug of the lock 16. Alternatively, a projection 240 integral with the lock plug of the lock 16 may pass through the mounting hole 232. The projection 240 may have an externally threaded portion for engagement by a nut, or the projection 240 may have a threaded hole for engagement by a screw. The nut or screw would then frictionally hold the lock pawl 72 in place such that the lock pawl rotates with the lock plug of the lock 16. As another example, the projection 240 may have a non-circular shape which matches the non-circular shape of an alternative form of the mounting hole 232, thus causing the lock pawl 72 and the lock plug of the lock 16 to rotate as a unit. A nut or screw 242 may then be used as previously described to keep the lock pawl 72 from falling away from the lock plug of the lock 16. The pawl 72 may be mounted to the lock plug of the lock 16 in any suitable way so as to fix the lock pawl for rotation with the lock plug of the lock 16 on operating the lock plug by an appropriate key.

Preferably, the lock plug of the lock 16 is operated by a conventional blade-type key. Alternatively, the lock plug may be operated by a binary key or other tool, such as a hex key or other similar tool not shown.

The operation of the latch when mounted to a closure member will now be described. The handle 26 can be rotated into a down position so that latch assembly 14 and handle 26 are both received within the cup 12. In this embodiment, the handle 26 is prevented from being folded down in all but the latched position of latch assembly 14, which is due to the position of the cavity 42 in the side wall 44 of the head 40 of housing 30. In this embodiment, the rib 36 of insert 33 is positioned in the first of the two depressions 58 of the driver 46 when handle 26 is in the down or retracted position. For operation of latch assembly 14, the handle 26 is pivoted to its open or extended position, which is approximately 90 degrees from the retracted position in this embodiment. In the present embodiment, the rib or boss 36 of insert 32 is positioned in the second of the depressions 58 when the T-handle 26 is in the extended position. The slug 35 acts as a spring biasing the rib 36 into engagement with the depressions 58 so as to provided a detent feature which holds the T-handle 26 in either the extended or retracted position. Assume for the moment that the lock plug of the lock 16 is in the unlocked position. Then the latch assembly 14 can be operated by rotation of handle 26. As the extended T-handle 26 is rotated to the unlatched position, the shaft 50 and the pawl 70 first move axially away from the keeper or frame member 244, and then the shaft 50 and the pawl 70 move rotationally to move the pawl 70 out of alignment with the frame member to thereby allow the closure member to be opened. The closure member can be latched after closing the closure member, by reversing the rotation of the T-handle 26. During the latching operation, the shaft 50 and the pawl 70 first move rotationally into alignment with the frame member, and then the shaft 50 and the pawl 70 move axially bringing the pawl 70 into engagement with the frame member. Once rotated to the latched position the T-handle 26 may be pivotally moved to the retracted position inside the cup 12, however, the lock 16 can only be accessed with a key with the T-handle 26 in the extended position. With the T-handle 26 in the retracted position inside the cup 12, the latch assembly 14 cannot be operated because of the interference of the head 40 of the housing 30 and/or the walls of the cup 12 with the T-handle 26.

With the T-handle rotated to the latched position but with the T-handle extended,a user can use a key to rotate the lock plug of the lock 16 to the locked position. With the lock plug of the lock 16 in the locked position, lock pawl 72 is positioned between the nuts 68 and 69 of the retaining means and the portion of the shaft 50 intermediate the nuts 68 and 69 is received in the U-shaped opening 234. Thus the nuts 68 and 69, in cooperation of the lock pawl 72, operate to prevent axial movement of the shaft 50 and consequently the rotation of the T-handle 26 out of its latched position. Thus an unauthorized user will not be able to move the T-handle 26 to the unlatched position even after moving the T-handle to the extended position. When an authorized user rotates the lock plug of the lock 16 to th unlocked position using key, the lock pawl 72 will move out from between the nuts 68 and 69 and th T-handle 26 can then be rotated to the unlatched position. As an alternative to the nuts 68 and 69, the shaft 50 may have a reduced diameter portion which defines a groove for receiving the end of the lock pawl 72 having the U-shaped opening 234, or the shaft 50 may be provided with any type of abutments in spaced apart relationship so as to receive the end of the lock pawl 72 having the U-shaped opening 234. In addition, when the latch assembly 14 is a type of which operates by rotation only, the lock pawl 72 may operate by having the sides of the U-shaped opening 234 engage the flats 228 of the shaft 50 which would prevent rotation of the shaft 50. This can be achieved by appropriately sizing the U-shapes opening 234. Further, having the sides of the U-shaped opening 234 engage the flats 228 of the shaft 50 can advantageously be used in combination with the nuts 68 and 69, or the other similar means enumerated above, in order to make it more difficult for an unauthorized user to defeat the latch 10 by over-torquing the T-handle 26.

It will be recognized by those skilled in the art that changes may be made to the above-described embodiments of the invention without departing from the broad inventive concept thereof. For example, the latch assembly 14 can be of other designs, such as the compression latch disclosed in U.S. Pat. No. 4,555,244. Also, the elements of the latch can be provided in other configurations as well and/or at other positions. For example, lock 16 can be provided on the handle 26. It is understood, therefore, that this invention is not limited to the particular embodiments disclosed, but it is intended to cover all modifications which are within the scope and spirit of the invention as defined by the appended claims.

We claim:

1. A latch for use with a closure member and an associated frame member, the latch comprising:

a housing adapted for installation to the closure member;

a latch assembly mounted to the housing and operable between a latched configuration and an unlatched configuration, said latch assembly including a latching pawl movable between latched and unlatched positions, and a shaft, said latching pawl being attached to said shaft and being movable responsive to movement of said shaft;

a lock mounted to said housing, said lock being selectively operable between a locked and unlocked configuration; and a lock pawl attached to said lock, said lock pawl being rotatable between a locked position and an unlocked position responsive to operation of said lock between said locked and unlocked configurations, said lock pawl having a U-shaped opening at spaced separation from said lock, wherein a portion of said shaft is received within said U-shaped opening when said lock pawl is in said locked position, and wherein said portion of said shaft has flats formed on either side thereof that engage said U-shaped opening when said lock pawl is in said locked position, whereby said lock pawl prevents said latching pawl from moving to said unlatched position when said lock pawl is in said locked position.

2. A latch according to claim 1, wherein said housing is in the form of a cup, said latch assembly includes a driver which moves rotationally to move said latching pawl between said latched and unlatched positions, and the latch further comprises a T-handle pivotally attached to said driver, said T-handle being pivotally movable between extended and retracted positions, and said T-handle being received within said cup when in said retracted position.

3. A latch according to claim 1, wherein said lock is a cylinder lock.

4. A latch for use with a closure member and an associated frame member, the latch comprising:

a housing adapted for installation to the closure member;

a latch assembly mounted to the housing and operable between a latched configuration and an unlatched configuration, said latch assembly including a latching pawl movable between latched and unlatched positions, and a shaft, said latching pawl being attached to said shaft and being movable responsive to movement of said shaft;

a lock mounted to said housing, said lock being selectively operable between a locked and unlocked configuration; and a lock pawl attached to said lock, said lock pawl being rotatable between a locked position and an unlocked position responsive to operation of said lock between said locked and unlocked configurations, said lock pawl having a U-shaped opening at spaced separation from said lock wherein a portion of said shaft is received within said U-shaped opening when said lock pawl is in said locked position to thereby prevent said latch assembly from being placed in said unlatched configuration when said lock pawl is in said locked position.

5. A latch according to claim 4, wherein said housing is in the form of a cup, said latch assembly includes a driver which moves rotationally to move said latching pawl between said latched and unlatched positions, and the latch further comprises a T-handle pivotally attached to said driver, said T-handle being pivotally movable between extended and retracted positions, and said T-handle being received within said cup when in said retracted position.

6. A latch according to claim 5, wherein said lock is a cylinder lock.

7. A latch for use with a closure member and an associated frame member, the latch comprising:

a housing adapted for installation to the closure member;

a latch assembly mounted to the housing and operable between a latched configuration and an unlatched configuration, said latch assembly including a latching pawl movable between latched and unlatched positions, and a shaft, said latching pawl being attached to said shaft and being movable responsive to movement of said shaft;

a lock mounted to said housing, said lock being movable between a locked position and an unlocked position responsive to operation of said lock between said locked and unlocked configurations; and at least one nut supported by shaft and abutting said pawl when said lock pawl is in said locked position to thereby prevent movement of said latching pawl from latched position to said unlatched position when said lock pawl is in said position.

8. The latch according to claim 27, wherein said at least one nut is a first nut and the latch further comprises:

a second nut supported by said shaft in spaced-apart relationship from said first nut, said first and second nuts being located on either side of said lock pawl when said lock pawl is in said locked position to thereby prevent movement of said latching pawl from said latched position to said unlatched position when said lock pawl is in said locked position.

9. The latch according to claim 7, wherein said shaft has a longitudinal axis and wherein said shaft has a movement having at least a component in a direction parallel to said longitudinal axis of said shaft as said latching pawl moves at least form one of said latched and unlatched positions to another of said latched and unlatched positions.

10. A latch according to claim 8, wherein said lock pawl has a U-shaped opening located at spaced separation from said lock, and wherein a portion of said shaft is received within said U-shaped opening when said lock pawl is in said locked position.

11. A latch according to claim 10, wherein said lock pawl moves rotationally between said locked position and said unlocked position.

12. A latch according to claim 11, wherein said portion of said shaft received within said U-shaped opening has flats formed on either side thereof that engage said U-shaped opening to prevent movement of said latching pawl to said unlatched position when said lock pawl is in said locked position.

13. The latch according to claim 12, wherein said shaft has a longitudinal axis and wherein said shaft has a movement having at least a component in a direction parallel to said longitudinal axis of said shaft as said latching pawl moves at least from one of said latched and unlatched positions to another of said latched and unlatched positions.

14. A latch according to claim 13, wherein said housing is in the form of a cup, said latch assembly includes a driver which moves rotationally to move said latching pawl between said latched and unlatched positions, and the latch further comprises a T-handle pivotally attached to said driver, said T-handle being pivotally movable between extended and retracted positions, and said T-handle being received within said cup when in said retracted position.

15. A latch according to claim 14, wherein said lock is a cylinder lock.

* * * * *

UNITED STATES PATENT AND TRADEMARK OFFICE

CERTIFICATE OF CORRECTION

PATENT NO. : 6,418,761 B1
DATED : July 16, 2002
INVENTOR(S) : Roger Wytcherley et al.

It is certified that error appears in the above-identified patent and that said Letters Patent is hereby corrected as shown below:

Column 7,
Line 6, before "T-handle", "th" should be changed to -- the --.
Line 12, after "latch assembly 14", "is a" should be changed to -- is of a --.
Line 18, "U-shapes" should be changed to -- U-shaped --.
Line 29, "4,555,244" should be changed to -- 4,556,244 --.

Column 8,
Line 55, change "movable" to -- selectively operable --.
Line 56, after "a locked" delete "position".
Line 56, change "unlocked position" to -- unlocked configuration; --.
Line 57, before "responsive", insert -- a lock pawl attached to said lock, said lock pawl being movable between a locked position and an unlocked position --.
Line 59, before "shaft" insert -- said --.
Line 59, before "pawl" insert -- lock --.
Line 62, before "latched" insert -- said --.
Line 63, between "said" and "position" insert -- locked --.
Line 64, "claim 27" should be changed to -- claim 7 --.

Signed and Sealed this

Twenty-fourth Day of June, 2003

JAMES E. ROGAN
*Director of the United States Patent and Trademark Office*